US010961761B2

(12) United States Patent
Vos et al.

(10) Patent No.: US 10,961,761 B2
(45) Date of Patent: Mar. 30, 2021

(54) PIVOT DOOR HINGE

(71) Applicant: FRITSJURGENS HOLDING B.V., Kolham (NL)

(72) Inventors: Bastiaan Vos, Kolham (NL); Dionne Ilonka Haanstra, Kolham (NL)

(73) Assignee: FRITSJURGENS HOLDING B.V., Kolham (NL)

( * ) Notice: Subject to any disclaimer, the term of this patent is extended or adjusted under 35 U.S.C. 154(b) by 0 days.

(21) Appl. No.: 16/624,352

(22) PCT Filed: Jun. 19, 2018

(86) PCT No.: PCT/EP2018/066275
§ 371 (c)(1),
(2) Date: Dec. 19, 2019

(87) PCT Pub. No.: WO2018/234313
PCT Pub. Date: Dec. 27, 2018

(65) Prior Publication Data

US 2020/0408019 A1 Dec. 31, 2020

(30) Foreign Application Priority Data

Jun. 19, 2017 (EP) ..... 17176622

(51) Int. Cl.
*E05F 3/10* (2006.01)
*E05F 3/12* (2006.01)
(Continued)

(52) U.S. Cl.
CPC ..... *E05F 3/104* (2013.01); *E05F 3/12* (2013.01); *E05F 3/20* (2013.01);
(Continued)

(58) Field of Classification Search
CPC ..... E05F 3/104; E05F 3/10; E05F 3/12; E05F 3/20; E05F 3/225; E05F 3/227;
(Continued)

(56) References Cited

U.S. PATENT DOCUMENTS 987,467 A * 3/1911 Katzenberger ..... E05D 3/00 16/281
2,035,823 A * 3/1936 Moore ..... E05D 11/1064 16/284
(Continued)

FOREIGN PATENT DOCUMENTS

CN 101018924 A 8/2007
CN 204357252 U 5/2015
(Continued)

OTHER PUBLICATIONS

Chinese Office Action dated May 25, 2020 for family member Application No. 201880046777.8.

*Primary Examiner* — Chuck Y Mah
(74) *Attorney, Agent, or Firm* — Hudak, Shunk & Farine Co. LPA

(57) ABSTRACT

Pivot door hinge, including a hinge housing for mounting the pivot door hinge to a door, a pivot axle pivotally supported within the housing, the pivot axle having an end arranged for rotationally anchoring the pivot axle to a structure holding the door, a closing mechanism arranged within the hinge housing, the closing mechanism being cooperatively connected to the pivot axle, the closing mechanism being arranged for providing a closing torque in an angular position range of the door hinge relative to the pivot axle, the angular position range corresponding with a door in an open state. The pivot door hinge further includes a braking mechanism arranged within the hinge housing, cooperatively connected to the pivot axle, the braking mechanism being arranged for providing braking action in
(Continued)

the angular position range of the door hinge relative to the pivot axle with a braking-angle profile.

18 Claims, 8 Drawing Sheets

(51) Int. Cl.
*E05F 3/20* (2006.01)
*E05F 3/22* (2006.01)

(52) U.S. Cl.
CPC ... *E05F 2003/228* (2013.01); *E05Y 2201/212* (2013.01); *E05Y 2201/638* (2013.01); *E05Y 2900/132* (2013.01)

(58) Field of Classification Search
CPC ..... E05F 2003/228; E05F 2201/212; E05Y 2201/638; E05Y 2800/268; E05Y 2900/132; E05Y 2600/452; E05Y 2600/41; E05D 7/086; E05D 7/10; Y10T 16/552; Y10T 16/5525; Y10T 16/56; Y10T 16/593; Y10T 16/2769; Y10T 16/2771; Y10T 16/2774; Y10T 16/283; Y10T 16/304
See application file for complete search history.

(56) References Cited

U.S. PATENT DOCUMENTS 2,603,818 A * 7/1952 Carlson ..... E05F 3/226 16/55
2,700,175 A * 1/1955 Carlson ..... E05F 1/1253 16/284
2,752,627 A * 7/1956 Carlson ..... E05F 3/104 16/55
3,210,796 A * 10/1965 Voester ..... E05F 3/104 16/55
3,246,362 A * 4/1966 Jackson ..... E05F 3/104 16/51
3,474,485 A * 10/1969 Mittig ..... E05F 3/104 16/55
4,000,540 A * 1/1977 Newlon ..... E05F 1/1253 16/298
4,763,384 A * 8/1988 Watabe ..... E05F 3/104 16/53
4,785,493 A * 11/1988 Tillmann ..... E05F 3/104 16/53
5,291,630 A * 3/1994 Brown ..... E05F 3/104 16/53
8,732,904 B2 * 5/2014 Busch ..... E05F 3/104 16/53
9,099,214 B2 * 8/2015 Mohammed Al-Saud ..... G02B 5/04
2005/0177975 A1 * 8/2005 Wang ..... E05F 3/04 16/60
2006/0123598 A1 * 6/2006 Park ..... E05F 3/225 16/378
2007/0033768 A1 * 2/2007 Ginzel ..... E05F 3/04 16/71
2010/0024159 A1 * 2/2010 Oh ..... E05F 3/104 16/54
2012/0311817 A1 * 12/2012 Bacchetti ..... E05F 3/04 16/51
2013/0081227 A1 * 4/2013 Hensh ..... E05F 3/104 16/53

FOREIGN PATENT DOCUMENTS

CN 204627257 U 9/2015
CN 106255794 A 12/2016
DE 10031403 A1 * 1/2002 ..... E05F 3/104
DE 102013100293 A1 7/2014
DE 102015109315 A1 12/2016
EP 0252554 A2 * 1/1988 ..... E05F 3/104
WO 2012049518 A1 4/2012

* cited by examiner

PIVOT DOOR HINGE

FIELD OF THE INVENTION

The invention relates to a pivot door hinge.

BACKGROUND OF THE INVENTION

Pivot door hinges in the art are connected to doors to provide hinge action relative to the ground threshold and an upper door frame head. Pivot door hinges can be provided with a closing mechanism and a braking mechanism. The braking mechanism is usually mechanically coupled to the closing mechanism to damp a closing motion of the door. A door having a pivot door hinge may have at least one preferential position, i.e. a closed position and/or an open position. When released from an open position, or a half open position, the closing mechanism will close the door by exerting a torque to the door to achieve its closed position. This greatly enhances user comfort in using the door for example by preventing undesired draft. Braking entails that whilst the door is in motion, this motion is damped in order to limit closing angular speed and prevent undesired oscillations in the door movements. This greatly improves safety in using the door.

Closing mechanisms are known to involve spring elements such as helical springs and/or pneumatic springs which act for example with a cam follower upon a cam on the pivot axle. Braking can be achieved by hydraulic means such as plungers or pistons connected to the closing mechanism which displace hydraulic fluid in a hydraulic fluid circuit driven by the cam follower. A hydraulic resistance in the hydraulic fluid circuit causes a pivotal braking action proportional to the angular speed for controlling the closing of the door.

A one-way valve disposed within the hydraulic fluid circuit parallel to the hydraulic resistance will be in an open state during an opening movement of the door, which causes the hydraulic fluid to flow through the one-way valve with low resistance. This allows the door to move freely to the open position. At closing the door, the one-way valve closes, and the hydraulic fluid is forced through the hydraulic resistance, thus providing braking action for controlling the closing action.

The combination of closing and braking mechanism as described may not provide sufficient braking torque for heavier doors. Especially in a mid-angle range near the open position and near the closed position the braking torque may be too low to prevent the door from uncontrolled opening and closing. Moreover, braking torque may be required when the door is being opened. The integrated closing and braking mechanisms in the art, providing braking torque while closing alone, i.e. during opening, may not provide the desired safe braking torque and allow a door to slam against end-stops at the end of their swing.

Also while closing the door, additional braking torque may be required when the door reaches its closed position, for preventing the so-called saloon door effect, wherein a door swings undamped back and forth through its closed position in case the door is hinged freely in a doorframe without stops. The combination of closing action and braking torque while opening and closing a door is difficult to achieve in pivot door hinges in the art.

Some pivot door hinges with combined spring based closing and braking mechanisms have their closing and braking mechanisms laterally interconnected and arranged within the hinge housing at opposite sides of the pivot axle, to keep dimensions in a direction parallel to the pivot axle at a minimum. This however causes the pivot door hinge to extend considerably in transverse direction such that the pivot axle is situated away from the door frame closest to the pivot axle, which allows the door portion between the door frame and pivot axis to open and close. Thereby a risk of objects or limbs accidentally being trapped between the door edge and door frame arises when the door is closed. Moreover, the pivot door hinge must be mountable within a cavity of the door. Thus, also thickness or dimensions in a direction perpendicular to the dear leaf surface must be kept minimal.

SUMMARY OF THE INVENTION

It is an object of the invention to provide a pivot door hinge having a braking mechanism to allow safe opening and closing of a door with braking torque. The pivot door hinge must be mountable within a cavity of the door, so the pivot door hinge must have minimal dimensions vertically, laterally and in thickness and have minimal distance to a door edge at the hinge side of the door for safety.

The object is achieved in a pivot door hinge, comprising a hinge housing for mounting the pivot door hinge to a door, a pivot axle pivotally supported within the housing, the pivot axle having an end arranged for rotationally anchoring the pivot axle to a structure holding the door, a closing mechanism arranged within the hinge housing, the closing mechanism being cooperatively connected to the pivot axle. The closing mechanism is arranged for providing a closing torque to the pivot axle, according to an angular position-torque profile. The pivot door hinge further comprises a braking mechanism arranged within the hinge housing, cooperatively connected to the pivot axle the braking mechanism being arranged for providing a braking torque for controlling at least one of the closing movement and an opening movement of the door.

The closing mechanism comprises a closing cam connected to the pivot axle arranged in a first buffer chamber of the hinge housing, wherein the closing cam has a closing cam profile corresponding to the angular position-torque profile. The closing mechanism further comprises a closing cam follower element, the closing cam follower element being arranged to contact the closing cam for exerting the closing torque on the pivot axle via the closing cam. The closing mechanism further comprises a first displacement device connected to the closing cam follower element wherein the first displacement device is arranged within a first pressure chamber of the hinge housing, a first spring element arranged within the first pressure chamber of the hinge housing, for exerting a first spring force to the first displacement device. The closing mechanism further comprises a first hydraulic circuit, operatively arranged between the first buffer chamber and the first pressure chamber, wherein the first displacement device is arranged to move a hydraulic fluid between the first pressure chamber and the first buffer chamber.

The braking mechanism comprises a braking cam connected to the pivot axle arranged in a second buffer chamber of the hinge housing, wherein the braking cam has a braking cam profile corresponding, wherein the braking cam profile is different from the closing cam profile, and a braking cam follower element arranged to contact the braking cam for exerting the braking torque on the pivot axle via the braking cam. The braking mechanism further comprises a second displacement device connected to the braking cam follower element wherein the second displacement device is arranged within a second pressure chamber of the hinge housing, a second spring element arranged within the second pressure chamber of the hinge housing, for exerting a second spring force to the second displacement device. The braking mechanism further comprises a second hydraulic circuit, operatively arranged between the second buffer chamber and the second pressure chamber, wherein the second displacement device is arranged to move a hydraulic fluid between the second pressure chamber and the second buffer chamber via at least one of a hydraulic resistance and a one way valve.

The braking cam has a braking profile comprising a first protrusion at an angle corresponding to an open-door position, and wherein the one-way valve is arranged to be open, to allow a hydraulic fluid to flow through the one-way-valve from the second buffer chamber to the second pressure chamber when in use the second displacement device moves towards the pivot axle.

So, when the door in use is closed from the open-door position, the braking cam is rotated and the first protrusion allows the second displacement device to approach the pivot axle. The hydraulic fluid is allowed to flow from the second buffer chamber to the second pressure chamber through the opened one-way-valve with relatively low resistance. The door is now allowed to close with no braking action from the braking mechanism.

The one-way valve is further arranged to block the hydraulic fluid, when in use the second displacement device moves away from the pivot axle to allow the hydraulic fluid to flow from the pressure chamber to the second buffer chamber via hydraulic resistance.

When in use the door is being moved to the open-door position, the first protrusion now pushes second displacement device away from the pivot axle. The hydraulic fluid is pressurized by the second displacement device which causes the one-way-valve to close and the hydraulic fluid is forced by the second displacement device to flow from the second pressure chamber to the second buffer chamber via the hydraulic resistance.

This allows the braking mechanism to provide braking torque in an opening movement of the door, i.e. door hinge, independent from the braking provided by the closing mechanism, thereby preventing the door from being uncontrollably slammed open. This significantly enhances door hinging applications, especially for large and heavy doors which closing and opening movement can now be controlled accurately.

In an embodiment, the braking cam has a braking profile comprising a second protrusion at an angular position corresponding to a closed-door position and an indentation at an angular position in between the first protrusion and the second protrusion.

This allows the braking mechanism to provide additional braking action in closing movement of the door near the closed-door position, i.e. door hinge, independent from the braking provided by the closing mechanism. This prevents the door from being slammed shut.

In an embodiment, the closing mechanism is further arranged for providing a first braking action for controlling a closing movement of the door.

In an embodiment the braking mechanism and the closing mechanism are arranged in the hinge housing on a same lateral side of the pivot axle.

This allows the pivot axle to be arranged close to the door edge near the door post, thus preventing a large opening between door leaf and doorpost near the rotation axis of the door hinge. This enhances safe operation of the door. The braking and closing mechanism can be arranged mutually above one another in axial direction of the pivot axle, thereby allowing a very compact design of the pivot door hinge.

This allows the first spring element, which may be a single heavy-duty spring or a coaxially aligned double spring for extra heavy doors, to provide the required closing torque. The closing cam is designed to provide the required torque for each angular position.

In an embodiment, the first hydraulic circuit comprises a first fluid channel between the first pressure chamber and the first buffer chamber, and a first one-way valve arranged within the first fluid channel. The first hydraulic circuit further comprises a second fluid channel between the first pressure chamber and the first buffer chamber, arranged in parallel to the first fluid channel, and a first fluid resistance arranged within the second fluid channel.

The first displacement device moving the hydraulic fluid with the first one-way valve open in one direction allows braking action in a one way and free movement in the opposite direction.

In an embodiment, the first fluid channel and the first one-way valve are arranged through the first displacement device. This saves space within the housing, as this first fluid channel need not be manufactured within the housing.

In an embodiment, the closing cam has a radius which substantially increases with increasing angular positions. The first one-way valve is arranged to allow a hydraulic fluid to flow from the first pressure chamber to the first buffer chamber when in use the first displacement device moves away from the pivot axle and wherein the first one-way valve is arranged to block the hydraulic fluid flow when in use the first displacement device moves towards the pivot axle.

The radius of the closing cam substantially increasing with increasing angular position causes the closing cam follower element and consequently the first displacement device to take up a position relative to the pivot axle to have a substantially increasing distance with increasing angular position. Thus, when the door opens, the angular position increases and the hydraulic fluid passes through the first one-way valve. When the angular position however decreases, the distance between the first displacement device and the pivot axle decreases substantially, causing the first one-way valve to close. The hydraulic fluid then passes through the first hydraulic resistance.

In an embodiment, the second hydraulic circuit comprises a third fluid channel between the second pressure chamber and the second buffer chamber, a second one-way valve arranged within the second fluid channel, a fourth fluid channel arranged in parallel to the third fluid channel, and a second fluid resistance arranged within the fourth fluid channel.

This allows the second displacement device moving the hydraulic fluid with the second one-way valve open in one direction braking action in one direction and free movement in the opposite direction.

In an embodiment, the third fluid channel and the second one-way valve are arranged through the second displacement device.

This allows flexible design of braking profiles for the pivot door hinge independent of the cam profile of the closing mechanism. Moreover, an angular shift from the first protrusion to another angular position allows free movement, whereas an angular shift from an angular position towards the protrusion allows for braking action due to the movement of the second displacement device away from the braking cam and pivot axle.

In an embodiment, the braking cam has a braking profile comprising the first protrusion at an angle corresponding to a closed-door position and a second protrusion at an angle in a range corresponding to an open-door position, and an indentation at an angular position in between the first protrusion and the second protrusion.

This allows braking in both opening and closing directions starting from the angular position of the indentation between the protrusions.

In an embodiment, the second hydraulic circuit further comprises a fifth fluid channel parallel to the third fluid channel and the fourth fluid channel, the fifth fluid channel comprising a relief valve.

This relief valve prevents overpressure to occur in the second pressure chamber when for a sudden uncontrolled movement involving braking, i.e. with the second one-way valve closed, is to be performed. This prevents all parts in the pivot door hinge to be damaged in such a situation which enhances safety and reliability of the door hinge.

In an embodiment, at least one of the first and the second fluid resistance is adjustable.

This allows independent adjustment of the braking torque.

In an embodiment, the braking cam has a symmetrical profile.

This allows the braking action to be symmetrical, i.e. the door will behave the same when opening or closing in both directions within the door frame.

In an embodiment, the closed-door position corresponds to a cam angle in a range of −20 to +20 degrees relative to a center line of the braking mechanism.

In an embodiment, the open-door position corresponds to an opening angle in a range of plus or minus 70-110 degrees relative to a center line of the braking mechanism.

In an embodiment, the second spring element has a spring constant in a ratio of at least 1 to 10, and preferably 1 to 15, relative to a spring constant of the first spring element. This allows relatively small springs for the braking mechanism to be used resulting in a compact design of the pivot door hinge.

BRIEF DESCRIPTION OF THE DRAWINGS

Exemplary embodiments of the invention will be elucidated according the following drawings.

DETAILED DESCRIPTION OF EMBODIMENTS OF THE INVENTION

Exemplary embodiments of the invention will be further elucidated according the following detailed description. Throughout the application, where the wording angle or angular position is used, an absolute angle is intended, except where indicated otherwise.

Figure 1:
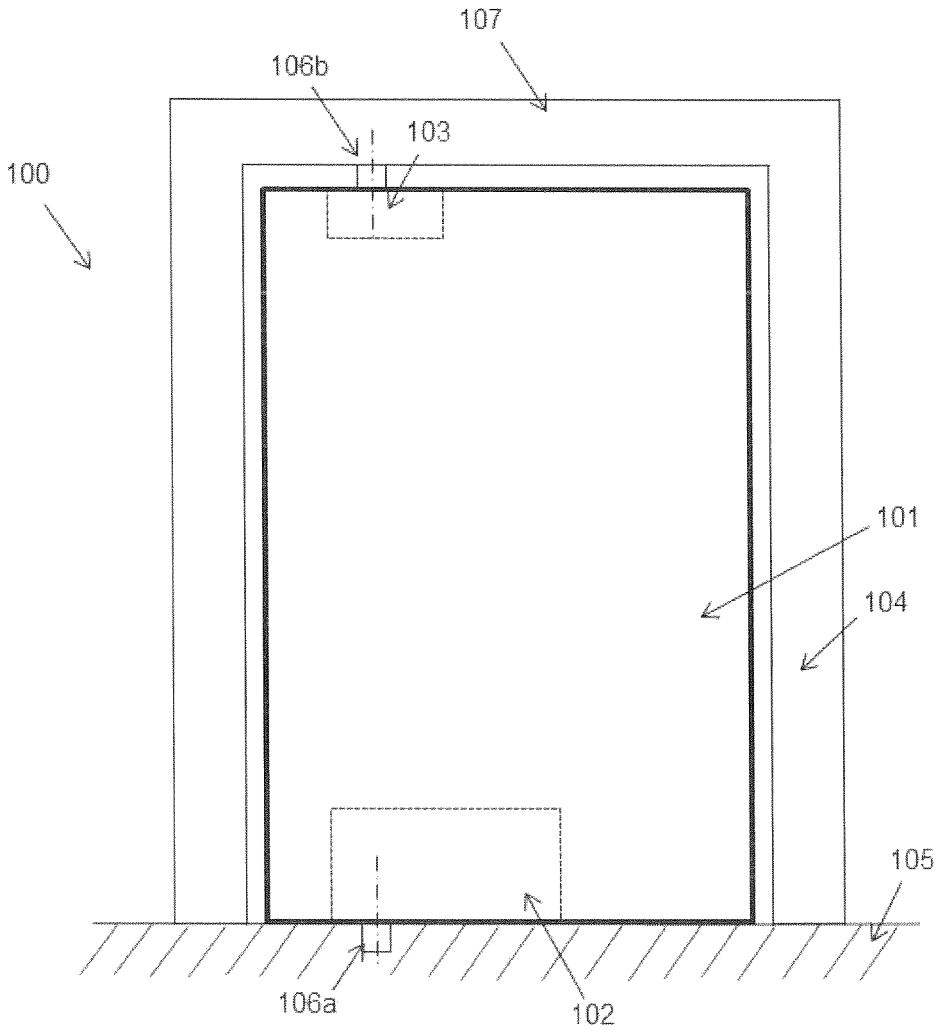
FIG. 1 shows a door in a door frame having a door hinge according to an embodiment of the invention.

FIG. 1 shows a door system 100 comprising a door leaf 101 which is hingeably mounted in a door frame 104 using a pivot door hinge 102 and a top hinge 103 using pivot axles 106*a*,106*b* respectively. The axle 106*a* is fixedly mounted to a corresponding holder on the ground 105 or threshold or sill as the pivot axle 106*b* is fixedly mounted to the top 107 of the door frame 104.

The top 107 can be a lintel for example. The door leaf 101 can swing around the rotation axles 106*a*,106*b* is a single direction or preferably in both directions to and in FIG. 2 a torque versus angle diagram is shown of a pivot door hinge, wherein the torque is the torque exerted by the hinge mechanism relative to a rotation access of the pivot door hinge and the angle $\alpha$ is the angle of the rotation access relative to the pivot door hinge.

Figure 2:
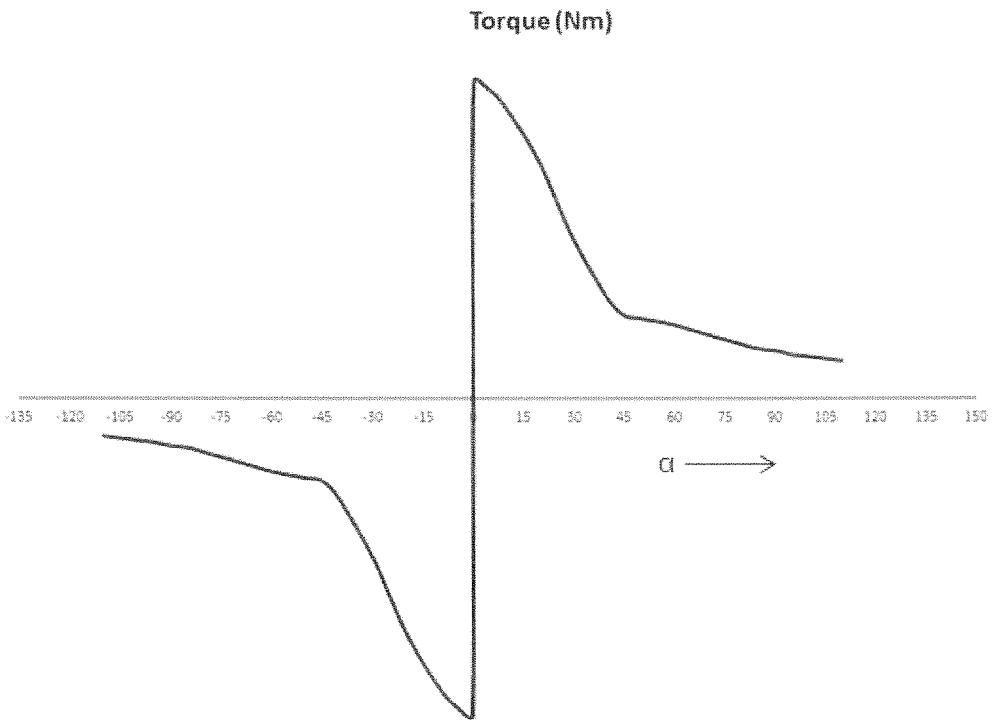
FIG. 2 shows a closing torque vs angular position diagram of the pivot door hinge according to an embodiment of the invention.

FIG. 2 shows a desired torque versus angular position diagram for angle in a range from −110° to +110°. From the diagram it is clear that a high torque is required in angle positions around 0°, in order to provide a door wherein the pivot door hinge is mounted a stable position at this angle. For angles higher than 0° it is clear that the torque exerted on the rotation axle decreases with increasing angle.

From FIG. 2 it is also clear that even for angles higher than 90° a closing torque is to be exerted on the pivot door hinge allowing the door wherein the pivot door hinge is mounted to return to its closed position. The torque-angular position diagram in FIG. 2 is point symmetrical, i.e. for angles smaller then 0°, a similar torque can be exerted on the rotation axle by the pivot door hinge. The skilled person will recognize that also asymmetrical torque-angle diagrams may apply.

Figure 3:
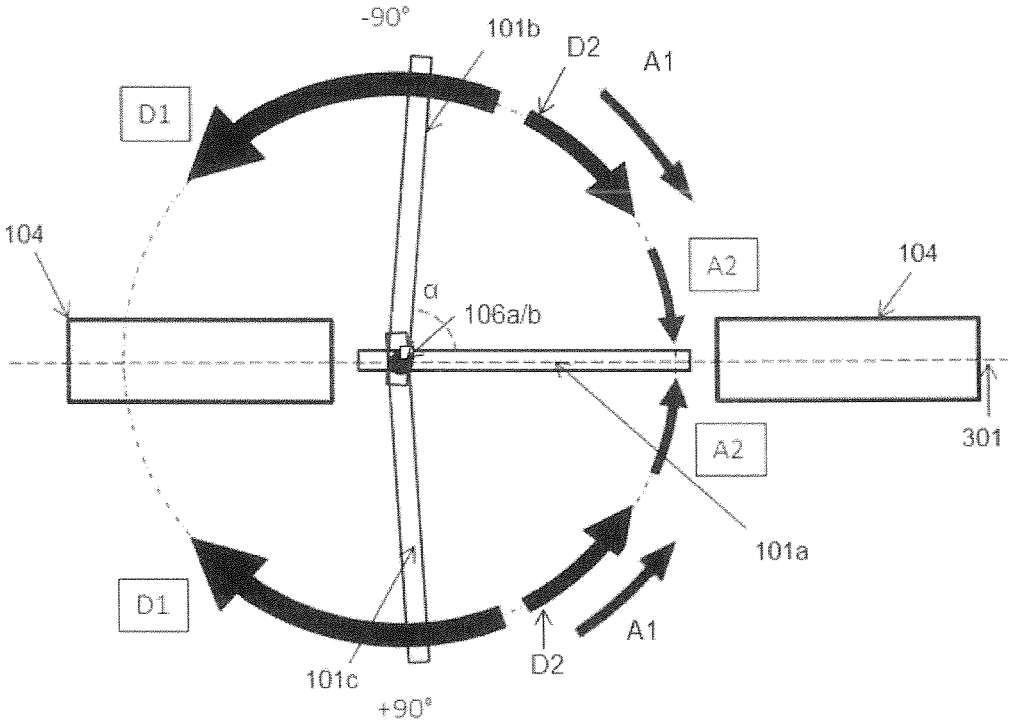
FIG. 3 shows a braking vs angular position diagram of the pivot door hinge according to an embodiment of the invention.

In FIG. 3, a diagram is shown showing desired braking resistance of the pivot door hinge in various angle zones A1, A2, D1, D2. The zones A1, A2 indicate braking action while closing the door moving from position 101*b* to position 101*a* and moving from position 101*c* to positions 101*a*. The zone A1 usually corresponds to all open positions, for example from over 90° to 0°. Thus, braking is to be provided over the entire range of open door positions while closing. The zone A2 indicates a zone having an optionally lower braking resistance than zone A1. This allows a door to assume its closed position more easily.

Furthermore, braking is to be provided in the zone indicated with D1 while opening the door. In zone D2 braking is provided additional to zone A1 while closing the door.

Figure 4:
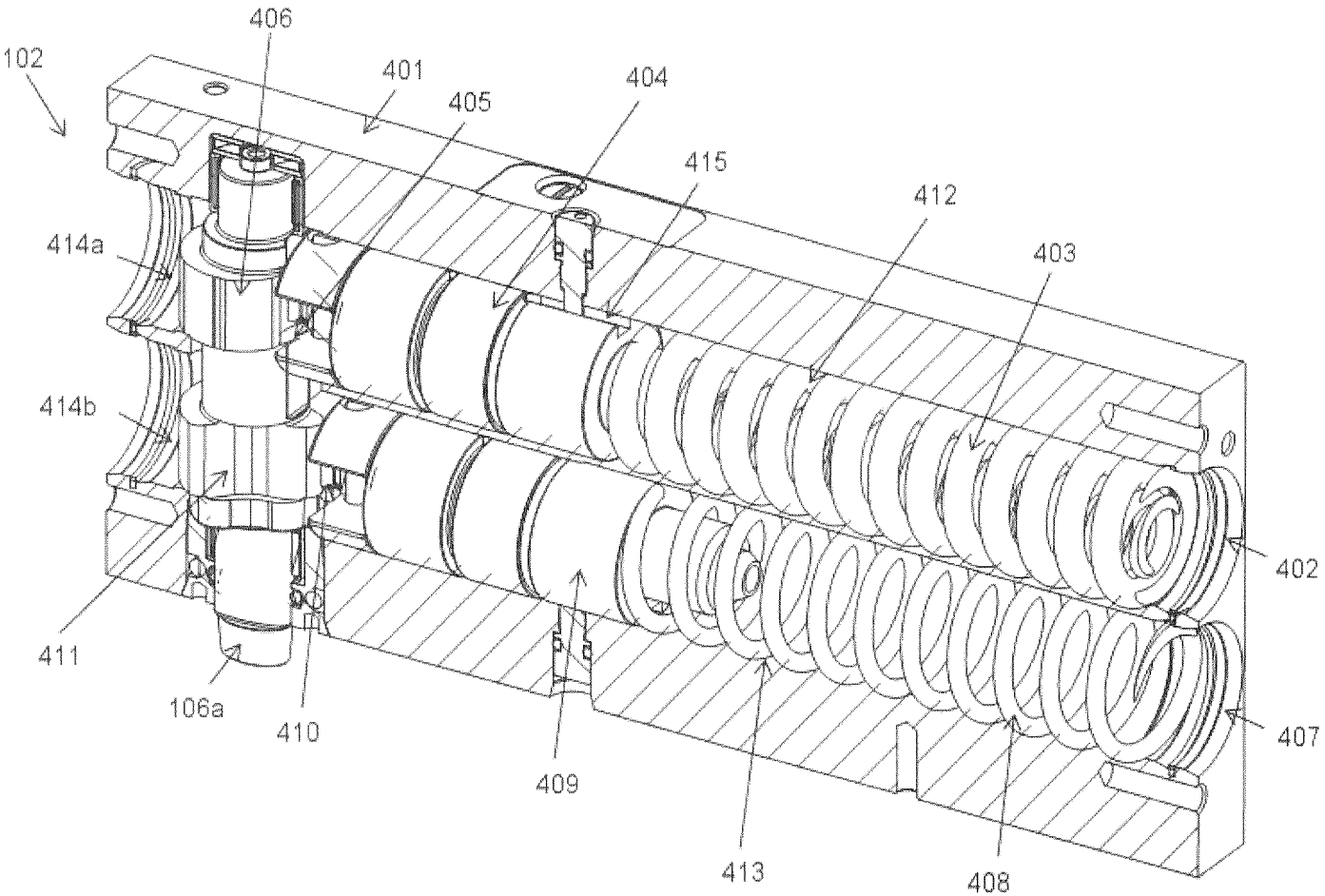
FIG. 4 shows a cut-away view of the pivot door hinge according to an embodiment of the invention.

FIG. 4 shows a cut away view of the pivot door hinge which is usually mounted at the lower part of the door. The pivot door hinge 102 comprises a housing 401, a closing mechanism 402 which comprises a closing spring 403, a displacement device for the closing mechanism 402 in the form of closing plunger 404, a closing cam 406 with camp follower 405. The pivot door hinge 102 further comprises a braking mechanism 407, which comprises a braking spring 408, another displacement device for the braking mechanism 407 in the form of a braking plunger 409, a braking cam 411 and corresponding cam wheel 410 acting as a cam follower connected to the braking plunger 409. The cam 406 for the closing mechanism 402 and the braking cam 411 for the braking mechanism 407 are mounted at mutually exchangeable positions of the rotation axle 106*a*. The closing mechanism 402 and braking mechanism 407 are mounted in respective cavities forming pressure chambers 412, 413 for the respective closing mechanism 402 and braking mechanism 407 within the pivot door hinge housing 401. The pivot axle 106*a* is accommodated in buffer chambers 414*a*, 414*b*, corresponding to the closing cam 406 and the braking cam 411 respectively. Where the pressure chambers 412, 413 for the closing mechanism 402 and braking mechanism 407 respectively are fluidly separated, the buffer chambers 414*a*, 414*b* for the pivot axle 106*a* and the respective closing cam 406 and braking cam 411 may be fluidly interconnected. These buffer chambers 414*a*, 414*b* are designed to hold a hydraulic fluid which is displaced by the respective plungers 404, 409 of the closing mechanism 402 and braking mechanism 407.

Figure 5A:
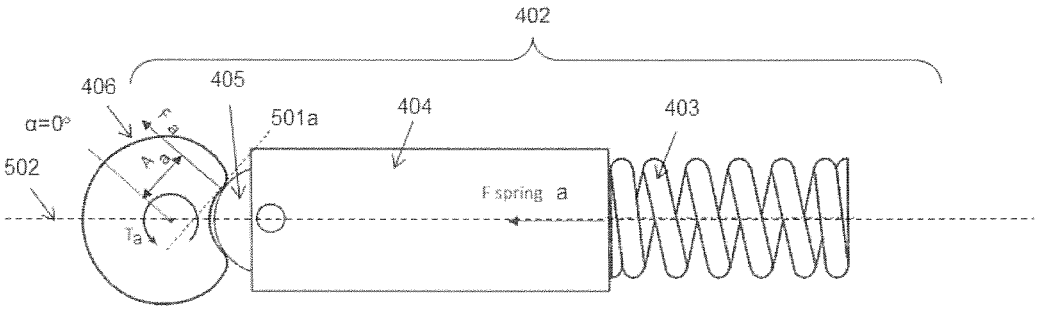
FIGS. 5*a*, 5*b* show cam element and cam follower positions for various angular positions of the closing mechanism of the pivot door hinge according to an embodiment of the invention.
Figure 5B:
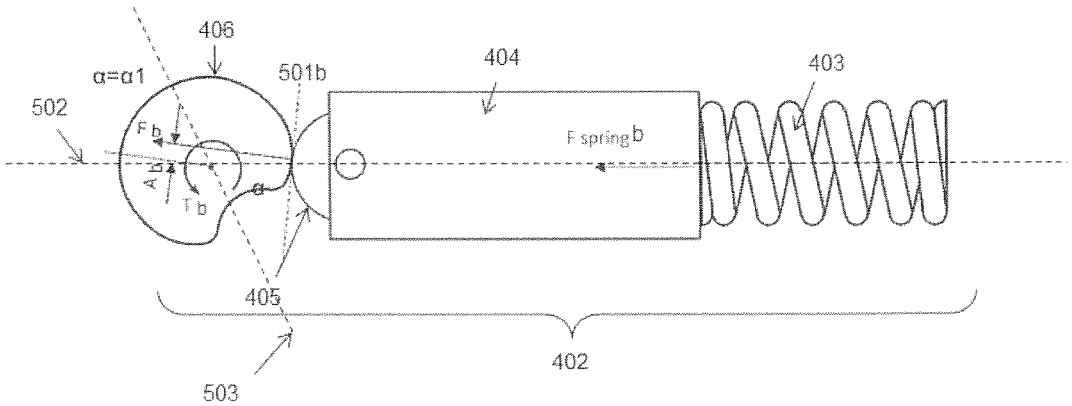

FIGS. 5*a*, 5*b* show a closing mechanism 402 at different angles α of the closing cam 406 relative to a center line 502 of the closing mechanism 402. The closing mechanism 402 comprises the closing spring 403, the plunger 404 accommodated in the closing mechanism pressure chamber 412 of the housing 401, the closing cam 406 being mounted on the pivot axle 106*a*.

In FIG. 5*a* corresponding to a closed-door position, the cam follower 405, which is shown as a cam wheel, rests against an indentation of a heart shaped closing cam 406. In the upper section of the closing cam 406, cam wheel 405 contacts the cam 406 at tangent 501*a*. As the closing spring 403 exerts a force $F_{spring\ a}$ to the closing cam 406, a force $F_a$ is exerted in a direction perpendicular to the tangent 501*a*, at an arm with length $A_a$, a torque $T_a$ is exerted on the cam 406. Since the cam wheel 405 also contacts the closing cam 406 at a point symmetrical of the center line 502 the total torque exerted however on the closing cam 406 is reduced to 0.

Slight changes in the cam angular position relative to the cam wheel 405 will result in a steep increase in the exerted torque $T_a$ of the pivot axle 106*a*. This corresponds to the high peek in the torque-angle diagram of FIG. 2 for angular positions a around 0°.

In FIG. 5*b*, the cam wheel 405 touches the closing cam 406 at tangent 501*b*. The closing cam 406 has rotated with an angle of α1 relative to the centerline 502. The distance between the center of the closing cam 406 and the center of the cam wheel 405 has increased which gives rise to an increased force $F_{spring\ b}$ of closing spring 403 to the plunger 404. The force $F_b$ exerted by the cam wheel 405 to the closing cam 406 at arm length $A_b$ results in a torque $T_b$ exerted on the cam 406 and subsequently on the pivot axle 106*b*.

The angle α1 in FIG. 5*b* corresponds to an angle α of closing cam center line 503 in an exemplary range between 45° and 110° as shown in FIG. 2. In this range the torque $T_b$ exerted on the closing cam 406 and subsequently the pivot axle 106*a* is less than the torque $T_a$ exerted in the lower angle α regions between 0° and 45°.

Figure 6A:
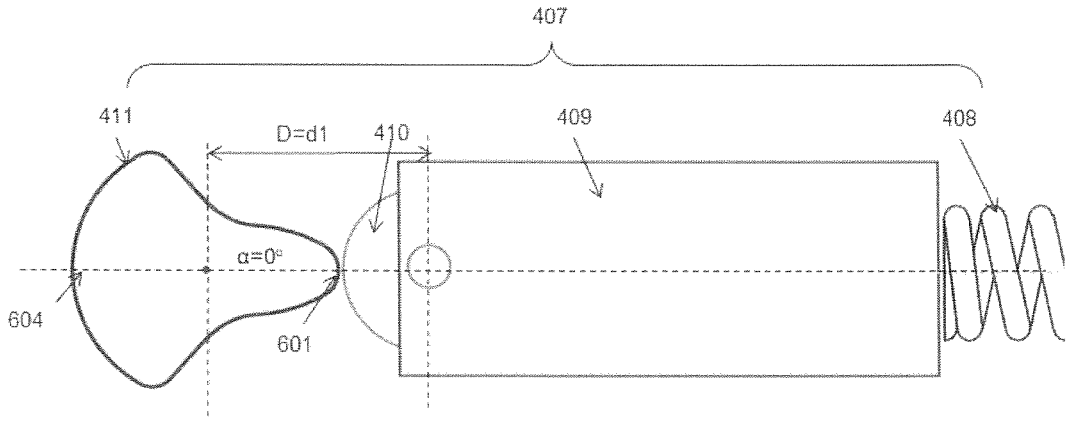
FIGS. 6*a*-6*c* show cam element and cam follower positions for various angular positions of the braking mechanism of the pivot door hinge according to an embodiment of the invention.
Figure 6B:
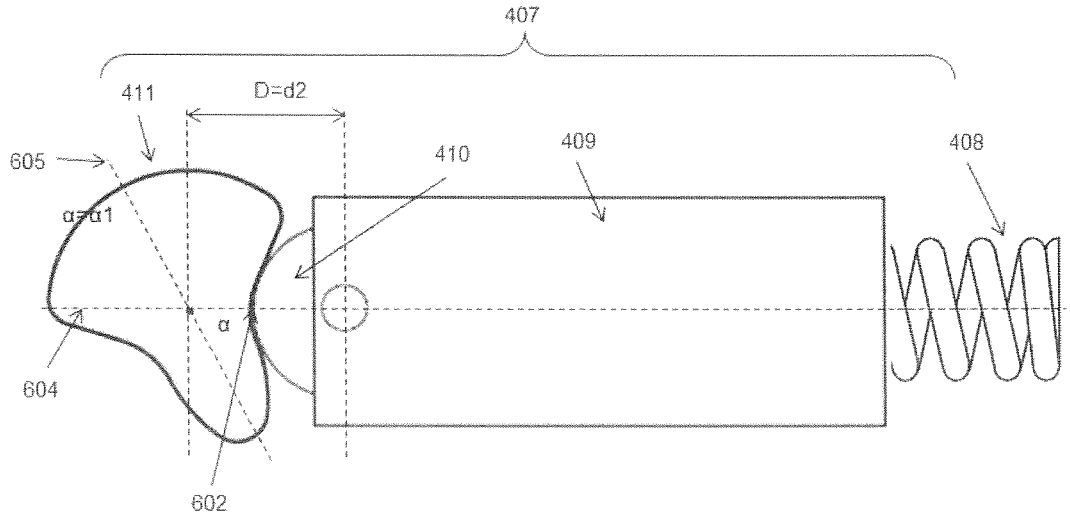
Figure 6C:
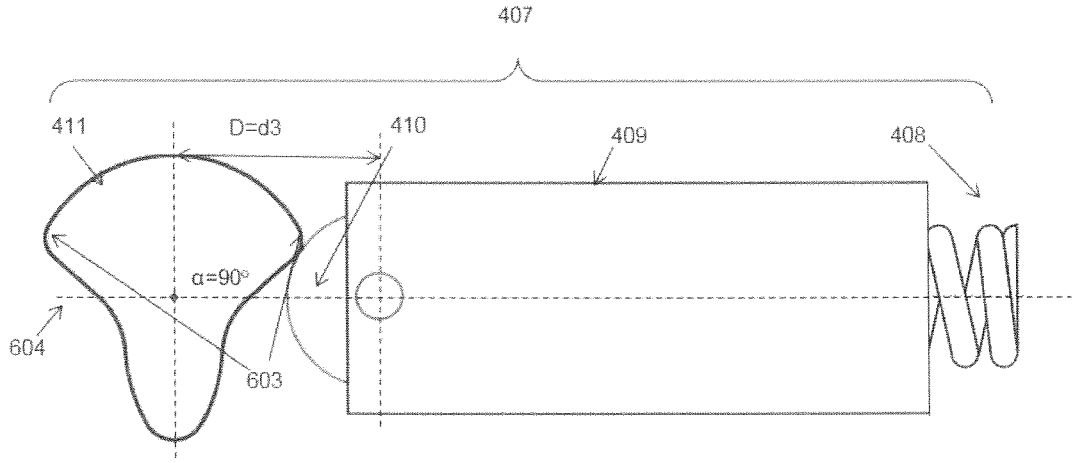

FIGS. 6*a*-6*c* show the braking mechanism 407 for different angles of the pivot axle 106*a* and corresponding angles of the braking cam 411. The distance D between cam wheel 410 center point to the rotation point of the braking cam 411 will vary depending on the rotation angle α relative to braking cam center line 605. This distance D determines the position of braking plunger 409 within pressure chamber 413. The braking plunger 409 displaces hydraulic liquid within the pressure chamber 413 to the cam buffer chamber 414*b* of FIG. 4. The flow of this hydraulic fluid and resistance provided in the path of the hydraulic fluid provides braking torque of the braking mechanism 407. The braking cam 411 is shown FIGS. 6*a*-6*c* symmetrically built relative to braking cam center line 605 to have the same profile for corresponding angles α>0° and angles α<0°, however the braking cam 411 may also be asymmetrical to have a different profile for angles α>0° and angles α<0°. The braking cam 411 has a protrusion 601 arranged to push cam wheel 410 away from the pivot axle center (indicated as a black dot within the braking cam 411 at low angles α corresponding to a closed-door position.

The braking cam 411 has another protrusion 603 arranged to push cam wheel 410 away from the pivot axle center at angles α corresponding to an open-door position.

In FIG. 6*a*, the cam wheel 410 touches the braking cam 411 at protrusion 601. The shown position corresponds with closed door position at α=0°. Distance D=d1 which corresponds to a maximum value in this position. When departing from this position with increasing angular positions in small ranges relative to angle α=0°, the distance D will decrease and become less than d1. Vice versa, with decreasing angular positions in small ranges relative to angle α=0°, the distance D will increase and approach the maximum value d1.

In FIG. 6*b*, the braking mechanism 407 is shown corresponding to a door open position at α=α1, wherein the cam wheel 410 touches the braking cam 411 at indentation 602. Distance D=d2 is at a minimum value in this position, (i.e. d2<d1). With an increasing angle α deviating from the shown position corresponding to range D1 of FIG. 3, the cam wheel 410 center point will increase the distance D from the rotation point of the braking cam 411 to enable additional braking torque on top of the braking of the closing mechanism 402. Moreover, with a decreasing angle α deviating from the shown position corresponding to range D2 of FIG. 3, the cam wheel 410 center point will also increase its distance D from the rotation point of the braking cam 411 to enable additional braking action on top of the braking of the closing mechanism 402.

In FIG. 6*c*, the cam wheel 410 touches the braking cam 411 at protrusion 603. The shown position corresponds with open door position at α=90°. Distance D=d3 which corresponds to another braking resistance value in this position, (i.e. d3>d2). As can be seen in FIG. 6*c*, the protrusion 603 may have an angular offset relative to the open-door position α=90°. So when the pivot axle 106*a* and braking cam 411 are in the open-door position, protrusion 603 may be positioned at angle relative to center line 604.

When departing from this position, while closing the door the distance D will decrease and become less than d3, going to D=d2 as shown in FIG. 6*b*. In an opposite direction, further opening the door from beyond the position shown in FIG. 6*c*, after passing the protrusion 603 with cam wheel 410, the distance D remains constant.

The braking spring 408 of the braking mechanism 407 may have a spring constant which is sufficient to keep the cam wheel 410 in touch with the braking cam 411. The closing spring 403 however must be dimensioned with a spring constant sufficiently high enough to provide closing torque when de door is in an open position.

The ratio between braking constant and closing constant can be 1 to at least 5. Preferably the ratio can be 1 to at least 15, more preferably the ratio can be 1 to at least 25.

Figure 7:
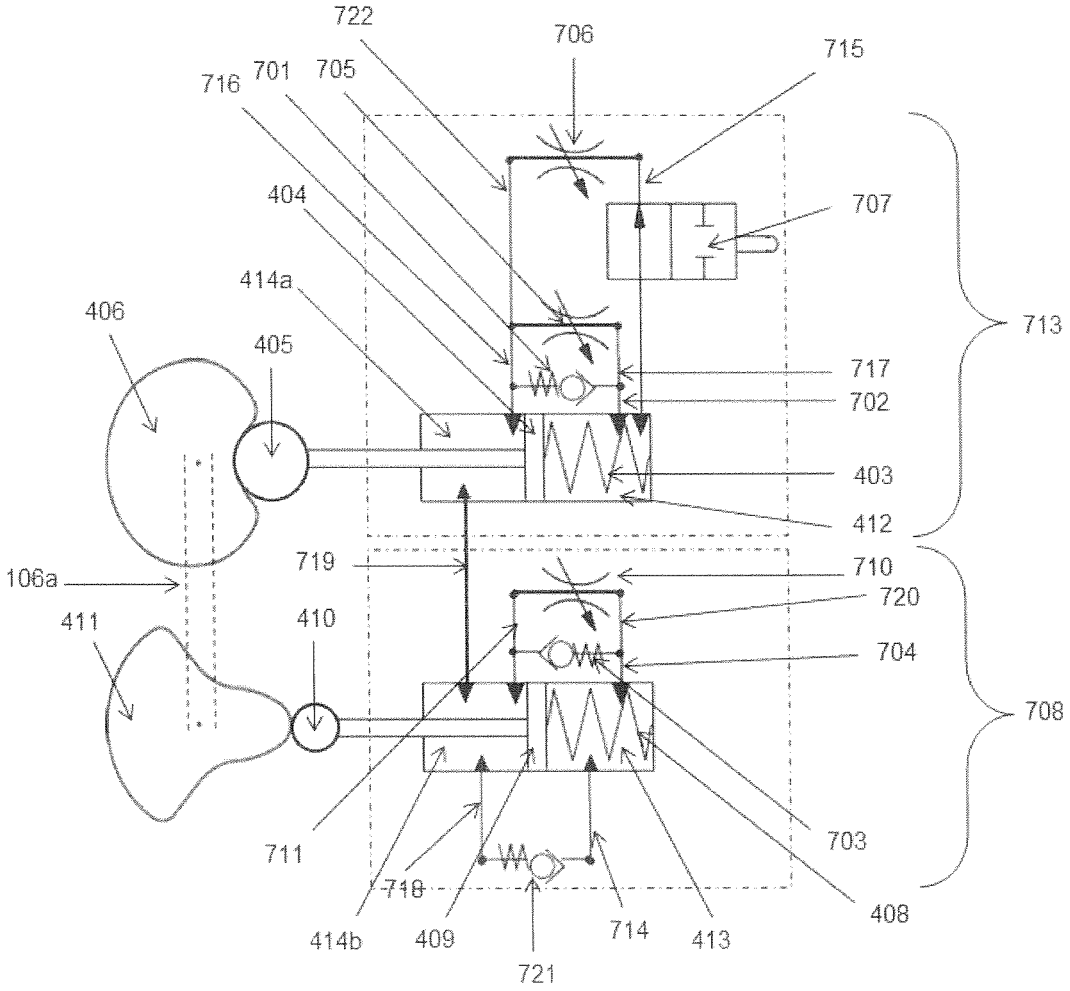
FIG. 7 shows a schematic hydraulic diagram of the pivot door hinge according to an embodiment of the invention.

FIG. 7 shows an optional hydraulic circuit 713 for the closing mechanism 402 and a hydraulic circuit 708 for the braking mechanism 407. In FIG. 7, the closing cam 406 of the closing mechanism 402 and braking cam 411 of the braking mechanism 407 respectively are shown in top view respectively and being schematically interconnected by pivot axle 106*a* with a dashed double line. Normally the cams 406, 411 are attached to the pivot axle 106*a* in a spaced manner.

The plunger 404 is actuated by the cam wheel 405 and closing cam 406 in accordance with FIGS. 6*a*-6*c*. The circuit 713 further comprises one-way valve 701 which is arranged in a hydraulic fluid channel 702 through the plunger 404. Parallel to the hydraulic fluid channel 702 a path comprising channels 717, 716 is arranged within the housing 401 which comprises a variable hydraulic resistance 705. Furthermore, the circuit comprises a bypass 707 and hydraulic resistance 706 included in series in hydraulic fluid channel 715-722.

When cam wheel 405 pushes the closing cam 406 against closing spring 403 while opening the door, hydraulic fluid in the pressure chamber 412 is pushed by the plunger 404 through the one-way valve 701. This way easy opening of the door with relatively low resistance is achieved. When on the other hand cam wheel 405 is pushed away from the closing cam 406 while closing the door, the one-way valve 701 closes and hydraulic fluid in the buffer chamber 414*a* is pushed by the plunger 404 through the channel 716 and hydraulic resistance 705 and hydraulic fluid channel 717 to pressure chamber 412. This way braking torque is achieved for the closing motion of the door. For small opening angles $\alpha$ near 0°, the bypass 707 may direct the hydraulic fluid through hydraulic fluid channel 722 and hydraulic resistance 706 to hydraulic fluid channel 715, thereby creating a lower resistance and corresponding lower braking torque for these angles. This allows the door to move from an open position to a completely closed position. Braking torque is proportional to the angular door speed and proportional to the fluid resistance value of hydraulic resistance 706.

The hydraulic circuit 708 for the braking mechanism 407 comprises the pressure chamber 413 in which the braking plunger 409 and braking spring 408 are arranged. The buffer chamber 414*b* is the buffer chamber for the hydraulic fluid of the hydraulic circuit 708 for the braking mechanism 407. As discussed, the braking plunger 409 is actuated by the cam wheel 410 and braking cam 411. The hydraulic circuit 708 comprises one-way valve 703 which is arranged in a hydraulic fluid channel 704 through the braking plunger 409. Parallel to the hydraulic fluid channel 704 a hydraulic fluid channel 720 is arranged within the housing 401 which comprises a variable hydraulic resistance 710. Furthermore, the hydraulic circuit 708 comprises a path comprising hydraulic fluid channels 714, 718 having a pressure relief valve 721. For pressures above a threshold value, for example 30 Bar, the pressure relief valve 721 will open to prevent damage to the hydraulic circuit 708 and the mechanical components, i.e. the pressure chamber 413.

When the door is closed in angular range D2 of FIG. 3, corresponding to the braking cam 411 angular position decreasing from indentation 602 to protrusion 601, braking cam 411 pushes cam wheel 410 and braking plunger 409 against the braking spring 408. The distance between the braking cam center point and cam wheel 410 center point increases and thereby the braking plunger 409 causes the hydraulic fluid in the pressure chamber 413 to be pushed in hydraulic fluid channel 704 and the one-way valve 703 to be closed. The hydraulic fluid subsequently passes through hydraulic fluid channel 720, 711 to the buffer chamber 414*b* via hydraulic resistance 710.

In the reverse direction while opening the door in this zone D2, the one-way valve 703 is opened and the hydraulic fluid flows through one-way valve 703 with relatively low resistance or braking torque.

When the door is opened further however corresponding to angular positions in zone D1 in FIG. 3, with increasing angular position relative to position of indentation 602 towards protrusion 603 in FIG. 6*c*, the cam wheel 410 is again pushed away from the braking cam 411 center point, the braking plunger 409 causes the hydraulic fluid in the pressure chamber 413 to be pushed in hydraulic fluid channel 704 and the one-way valve 703 to be closed, and the hydraulic fluid subsequently passes through hydraulic fluid channel 720, 711 to the buffer chamber 414*b* via hydraulic resistance 710, thereby causing braking action.

In the reverse direction while closing the door in this zone D1 of FIG. 3, the one-way valve 703 is opened and the hydraulic fluid flows through one-way valve 703 with relatively low resistance or braking torque.

The door having the door hinge 102 is thus protected against uncontrolled swinging open through its open position at or around 90°.

Figure 8:
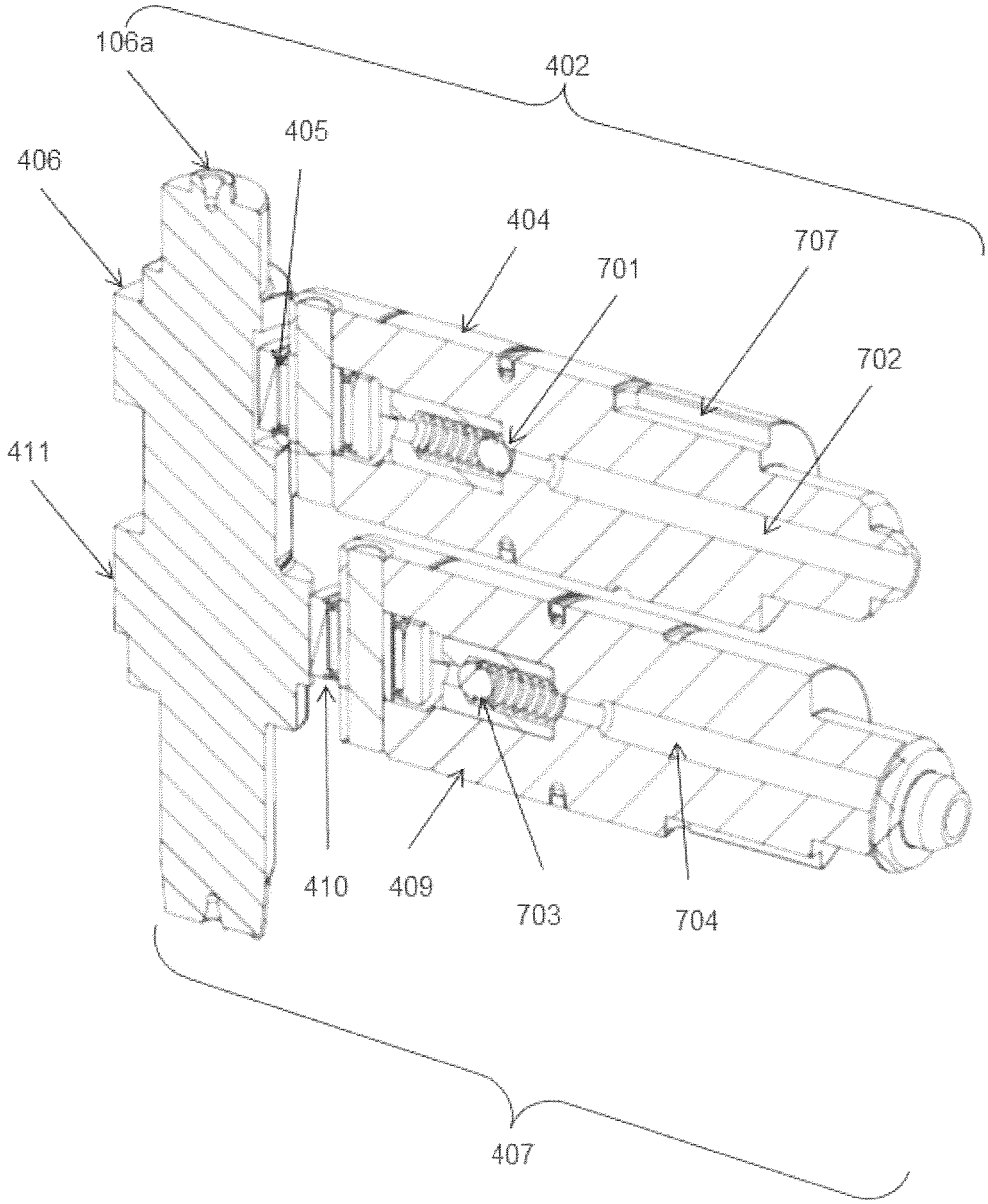
FIG. 8 shows a closing mechanism and braking mechanism having valves of the pivot door hinge according to an embodiment of the invention.

FIG. 8 shows across section view of the closing mechanism 402 and braking mechanism 407. The one-way valve 701 of the closing mechanism is shown arranged within the closing plunger 404, having its blocking opening facing the closing cam 406 which is arranged in buffer chamber 414*a*, and it's through opening facing hydraulic fluid channel 702. The one-way valve 701 and hydraulic fluid channel 702 may alternatively be arranged in the housing 401.

The bypass 707 of the closing mechanism hydraulic circuit 713 may be formed as a slit in the closing plunger 404.

The one-way valve 703 of the braking mechanism 407 is shown arranged within the braking plunger 409, having its blocking side facing the braking cam 411 which is arranged in buffer chamber 414*b*, and it's through opening facing hydraulic fluid channel 704. The one-way valve 703 and hydraulic fluid channel 704 may alternatively also be arranged within the housing 401.

The embodiments as described are provided by way of example only. Modifications and deviations are possible without deviating from the scope as defined by the claims set out below.

Throughout this application, the wording fluid channel may involve one or more fluid channel segments arranged in series optionally including a fluid resistance or valve. Moreover a fluid channel or channel segment may be a duct or a hidden channel bored or cast into the hinge housing.

Furthermore, where the wording plunger is used, also the wording piston can be used. Pistons and plungers can be categorized as positive displacement devices.

It will be clear to a person skilled in the art that the scope of the present invention is not limited to the examples discussed in the foregoing but that several amendments and modifications thereof are possible without deviating from the scope of the present invention as defined by the attached claims. In particular, combinations of specific features of various aspects of the invention may be made. An aspect of the invention may be further advantageously enhanced by adding a feature that was described in relation to another aspect of the invention. While the present invention has been illustrated and described in detail in the figures and the description, such illustration and description are to be considered illustrative or exemplary only, and not restrictive.

The present invention is not limited to the disclosed embodiments. Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference numerals in the claims should not be construed as limiting the scope of the present invention.

REFERENCE NUMERALS

| | |
|---|---|
| α | Cam angle relative to center line |
| 100 | Door system |
| 101 | Door leaf |
| 101a | Door leaf @ α = 0° |
| 101b | Door leaf @ α = −90° |
| 101c | Door leaf @ α = 90° |
| 102 | Pivot door hinge |
| 103 | Top hinge |
| 104 | Door frame |
| 105 | Ground |
| 106a, 106b | Pivot axle |
| 107 | Door frame top |
| 401 | Housing |
| 402 | Closing mechanism |
| 403 | Closing spring |
| 404 | Closing plunger |
| 405 | Cam wheel |
| 406 | Closing cam |
| 407 | Braking mechanism |
| 408 | Braking spring |
| 409 | Braking plunger |
| 410 | Cam wheel |
| 411 | Braking cam |
| 412,413 | Pressure chamber |
| 414a, 414b | Buffer chamber |
| 501a, 501b | Tangent |
| 502 | Closing mechanism center line |
| 503 | Rotated closing cam center line |
| 601, 603 | Protrusion |
| 602 | Indentation |
| 604 | Braking mechanism center line |
| 605 | Braking cam center line |
| 713 | Hydraulic circuit for the closing mechanism |
| 708 | Hydraulic circuit for the braking mechanism |
| 701, 703 | One-way valve |
| 702, 704, 711, 714-720, 722 | Hydraulic fluid channel |
| 705, 706, 710 | Variable hydraulic resistance |
| 707 | Bypass |
| 721 | Pressure relief valve |

What is claimed is:

1. A pivot door hinge, comprising:

a hinge housing for mounting the pivot door hinge to a door;

a pivot axle pivotally supported within the housing, the pivot axle (106*a*) having an end arranged for rotationally anchoring the pivot axle to a structure holding the door;

a closing mechanism arranged within the hinge housing, the closing mechanism being cooperatively connected to the pivot axle, the closing mechanism being arranged for providing a closing torque to the pivot axle, according to an angular position-torque profile; wherein the closing mechanism comprises:

a closing cam connected to the pivot axle arranged in a first buffer chamber of the hinge housing, wherein the closing cam has a closing cam profile corresponding to the angular position-torque profile; and a closing cam follower element, the closing cam follower element being arranged to contact the closing cam for exerting the closing torque on the pivot axle via the closing cam;

a first displacement device connected to the closing cam follower element wherein the first displacement device is arranged within a first pressure chamber of the hinge housing;

a first spring element arranged within the first pressure chamber of the hinge housing, for exerting a first spring force on the first displacement device;

wherein the first displacement device is arranged to move a hydraulic fluid between the first pressure chamber and the first buffer chamber;

a braking mechanism arranged within the hinge housing, cooperatively connected to the pivot axle, the braking mechanism being arranged for providing a braking torque for controlling at least one of a closing movement and an opening movement of the door, wherein the braking mechanism comprises:

a braking cam connected to the pivot axle arranged in a second buffer chamber of the hinge housing, wherein the braking cam has a braking cam profile, wherein the braking cam profile is different from the closing cam profile; and a braking cam follower element arranged to contact the braking cam for exerting the additional braking torque on the pivot axle via the braking cam;

a second displacement device connected to the braking cam follower element wherein the second displacement device is arranged within a second pressure chamber of the hinge housing;

a second spring element arranged within the second pressure chamber of the hinge housing, for exerting a second spring force on the second displacement device;

a braking mechanism hydraulic circuit, operatively arranged between the second buffer chamber and the second pressure chamber;

wherein the second displacement device is arranged to move a hydraulic fluid between the second pressure chamber and the second buffer chamber via at least one of a hydraulic resistance and a braking mechanism one-way valve of the braking mechanism hydraulic circuit; and wherein the braking cam has a braking profile comprising a first protrusion configured to be in contact with the braking cam follower element at an angle corresponding to an open-door position;

wherein the braking mechanism one-way valve is arranged to allow a hydraulic fluid to flow through the braking mechanism one-way valve from the second buffer chamber to the second pressure chamber when in use the second displacement device moves towards the pivot axle; and wherein the braking mechanism one-way valve is further arranged to block the hydraulic fluid, when in use the second displacement device moves away from the pivot axle to allow the hydraulic fluid to flow from the second pressure chamber to the second buffer chamber via the hydraulic resistance.

2. The pivot door hinge according to claim 1, wherein the closing mechanism comprises a closing mechanism hydraulic circuit, operatively arranged between the first buffer chamber and the first pressure chamber arranged for damping a closing movement of the door.

3. The pivot door hinge according to claim 2, wherein the first closing mechanism hydraulic circuit comprises:

a first fluid channel between the first pressure chamber and the first buffer chamber; and a closing mechanism one-way valve arranged within the first fluid channel;

a second fluid channel between the first pressure chamber and the first buffer chamber, arranged in parallel to the first fluid channel; and a first fluid resistance arranged within the second fluid channel; wherein the first fluid channel and the closing mechanism one-way valve are arranged through the first displacement device.

4. The pivot door hinge according to claim 3, wherein the closing cam has a radius which substantially increases with increasing angular positions; and the closing mechanism one-way valve is arranged to allow a hydraulic fluid to flow from the first pressure chamber to the first buffer chamber when in use the first displacement device moves away from the pivot axle and wherein the first closing mechanism one-way valve is arranged to block the hydraulic fluid flow when in use the first displacement device moves towards the pivot axle.

5. The pivot door hinge according to claim 4, wherein the braking mechanism hydraulic circuit further comprises a third fluid channel between the second pressure chamber and the second buffer chamber;

a fourth fluid channel, arranged in parallel to the third fluid channel; and a second fluid resistance arranged within the fourth fluid channel; wherein the third fluid channel and the braking mechanism one-way valve are arranged through the second displacement device.

6. The pivot door hinge according to claim 5, wherein the braking mechanism hydraulic circuit further comprises a fifth fluid channel parallel to the third fluid channel and the fourth fluid channel, the fifth fluid channel comprising a relief valve.

7. The pivot door hinge according to claim 2, wherein the braking cam has a braking profile comprising a second protrusion configured to be in contact with the braking cam follower element at an angular position corresponding to a closed-door position ($\alpha=0°$) and an indentation at an angular position ($\alpha=\alpha 1$) in between the first protrusion and the second protrusion.

8. The pivot door hinge according to claim 7, wherein the closing mechanism hydraulic circuit comprises:

a first fluid channel between the first pressure chamber and the first buffer chamber; and a closing mechanism one-way valve arranged within the first fluid channel;

a second fluid channel between the first pressure chamber and the first buffer chamber, arranged in parallel to the first fluid channel; and a first fluid resistance arranged within the second fluid channel; wherein the first fluid channel and the closing mechanism one-way valve are arranged through the first displacement device.

9. The pivot door hinge according to claim 8, wherein the closing cam has a radius which substantially increases with increasing angular positions; and the closing mechanism one-way valve is arranged to allow a hydraulic fluid to flow from the first pressure chamber to the first buffer chamber when in use the first displacement device moves away from the pivot axle and wherein the first closing mechanism one-way valve is arranged to block the hydraulic fluid flow when in use the first displacement device moves towards the pivot axle.

10. The pivot door hinge according to claim 9, wherein the braking mechanism hydraulic circuit further comprises a third fluid channel between the second pressure chamber and the second buffer chamber;

a fourth fluid channel, arranged in parallel to the third fluid channel; and a second fluid resistance arranged within the fourth fluid channel; wherein the third fluid channel and the braking mechanism one-way valve are arranged through the second displacement device.

11. The pivot door hinge according to claim 10, wherein the braking mechanism hydraulic circuit further comprises a fifth fluid channel parallel to the third fluid channel and the fourth fluid channel, the fifth fluid channel comprising a relief valve.

12. The pivot door hinge according to claim 11, wherein the closed door position corresponds to a cam angle in a range of −20 to +20 degrees relative to a center line of the braking mechanism.

13. The pivot door hinge according to claim 12, wherein the open-door position corresponds to an opening angle in a range of plus or minus 70-110 degrees relative to a center line of the braking mechanism.

14. The pivot door hinge according to claim 13, wherein the braking mechanism and the closing mechanism are arranged in the hinge housing on a same lateral side of the pivot axle.

15. The pivot door hinge according to claim 1, wherein the braking cam has a braking profile comprising a second protrusion configured to be in contact with the braking cam follower element at an angular position corresponding to a closed-door position ($\alpha=0°$) and an indentation at an angular position ($\alpha=\alpha 1$) in between the first protrusion and the second protrusion.

16. The pivot door hinge according to claim 15, wherein the closed door position corresponds to a cam angle in a range of −20 to +20 degrees relative to a center line of the braking mechanism.

17. The pivot door hinge according to claim 1, wherein the open-door position corresponds to an opening angle in a range of plus or minus 70-110 degrees relative to a center line of the braking mechanism.

18. The pivot door hinge according to claim 1, wherein the braking mechanism and the closing mechanism are arranged in the hinge housing on a same lateral side of the pivot axle.

* * * * *